US009774155B2

(12) United States Patent
Shimizu

(10) Patent No.: US 9,774,155 B2
(45) Date of Patent: Sep. 26, 2017

(54) ASSEMBLING STRUCTURE OF BUS BAR

(71) Applicant: Yazaki Corporation, Tokyo (JP)

(72) Inventor: Isanori Shimizu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 60 days.

(21) Appl. No.: 13/738,121

(22) Filed: Jan. 10, 2013

(65) Prior Publication Data

US 2013/0180751 A1 Jul. 18, 2013

(30) Foreign Application Priority Data

Jan. 17, 2012 (JP) ..... 2012-006845

(51) Int. Cl.
*H01R 25/16* (2006.01)
*H01R 13/41* (2006.01)
*H01R 9/22* (2006.01)

(52) U.S. Cl.
CPC ..... *H01R 25/161* (2013.01); *H01R 13/41* (2013.01); *H01R 9/226* (2013.01)

(58) Field of Classification Search
CPC ..... H01R 25/161; H01R 13/41
See application file for complete search history.

(56) References Cited

U.S. PATENT DOCUMENTS 2,990,533 A * 6/1961 Hughes ..... H01R 9/091 439/444
4,002,388 A * 1/1977 Menocal ..... 439/884
4,954,090 A * 9/1990 Shimochi ..... H01R 9/2458 439/329
5,017,159 A * 5/1991 Legrady ..... H01R 9/091 439/741
5,370,559 A * 12/1994 Matsuoka ..... H01R 13/41 439/733.1
5,431,587 A 7/1995 Matsuoka
6,231,401 B1 * 5/2001 Chooi Au Yong ... H01R 13/415 439/733.1
6,661,672 B2 * 12/2003 Ito ..... H05K 7/026 361/611

(Continued)

FOREIGN PATENT DOCUMENTS

JP H06-151000 A 5/1994
JP 2000-069648 A 3/2000

OTHER PUBLICATIONS

Office Action dated Aug. 11, 2015 issued for corresponding Japanese Patent Application No. 2012-006845.

*Primary Examiner* — William H Mayo, III
*Assistant Examiner* — Krystal Robinson
(74) *Attorney, Agent, or Firm* — Locke Lord LLP

(57) ABSTRACT

An assembling structure of bus bar is composed of a bus bar and a housing with which the bus bar is assembled. The bus bar is provided with a base portion extended in a band shape, a rectangular-plate-shaped press-fitting piece extended in a direction perpendicular to a longitudinal direction of the base portion from one end of the base portion, and an extended portion extended from the one end of the base portion and perpendicular to the press-fitting piece. The housing is provided with a press-fitting hole into which the press-fitting piece is to be press-fitted. Further, while the press-fitting piece is press-fitted into the press-fitting hole, the base portion and the extended portion abut on an outer periphery of the press-fitting hole.

3 Claims, 6 Drawing Sheets

(56) References Cited

U.S. PATENT DOCUMENTS

| | | | | |
|---|---|---|---|---|
| 8,696,367 | B2 * | 4/2014 | Daughtry, Jr. ..... | H01R 12/57<br>439/83 |
| 2004/0040733 | A1 * | 3/2004 | Yuasa ..... | H01R 13/17<br>174/68.2 |

* cited by examiner

ASSEMBLING STRUCTURE OF BUS BAR

CROSS REFERENCE TO RELATED APPLICATIONS

This application is on the basis of Japanese Patent Application No. 2012-006845, the contents of which are hereby incorporated by reference.

BACKGROUND OF THE INVENTION

Technical Field

The present invention relates to an assembling structure of bus bar for assembling the bus bar with a housing of an electronic device.

Background Art

Various structures have been proposed as an assembling structure of bus bar for assembling the bus bar with a housing of an electronic device (for example, see PTL 1). As one conventional example, the assembling structure of bus bar as shown in FIGS. 5 to 7 will be explained.

As shown in FIGS. 5 to 7, an assembling structure of bus bar 201 is composed of a bus bar 202 made by pressing a metal plate and a synthetic-resin-made housing 203 with which the bus bar 202 is assembled.

As shown in FIG. 5, the bus bar 202 is provided with a rectangular-plate-shaped press-fitting piece 221, a power-connecting portion 222, a pair of male type terminals 223 to be electrically connected to a not-shown electronic component, and a base portion 220 joining them together.

The housing 203 is provided with a fixing portion 230 to fix the fitting piece 221. thereto. As shown in FIG. 5, an outer shape of this fixing portion 230 is formed in a box shape. The fixing portion 230 is provided with a press-fitting hole 204 into which the press-fitting piece 221 is to be press-fitted, and a groove 205 into which a part of the base portion 220 in the vicinity of the press-fitting piece 221 is to be inserted.

Further, in FIGS. 5 to 7, an arrow Y indicates a direction parallel to a longitudinal direction of the press-fitting piece 221 and a height direction of the fixing portion 230, an arrow X indicates a direction parallel to a width direction of the press-fitting piece 221 and a width direction of the fixing portion 230, and arrow Z indicates a direction parallel to a thickness direction of the press-fitting piece 221 and a thickness direction of the fixing portion 230.

As shown in FIG. 7, a size in a width direction (a size in an arrow X direction) of the press-fitting hole 204 is formed a little larger than a size in a width direction of the press-fitting piece 221, and a size in a thickness direction (a size in an arrow Z direction) of the press-fitting hole 204 is formed smaller than a size in a thickness direction of the press-fitting piece 221.

According to the assembling structure of bus bar 201 having the above configuration, when the press-fitting piece 221 is press-fitted into between two faces facing each other in the arrow Z direction of the press-fitting hole 204, the press-fitting piece 221 is fixed to the fixing portion 230. Then, when the press-fitting piece 221 is fixed to the fixing portion 230, the bus bar 202 is assembled with the housing 203.

CITATION LIST

Patent Literature

Patent Literature 1: JP, A, 2000-069648

SUMMARY OF INVENTION

Technical Problem

However, in the above assembling structure of bus bar 201, there is a problem described below. Namely, because the size in the width direction (size in the arrow X direction) of the press-fitting hole 204 is formed a little larger than the size in the width direction of the press-fitting piece 221, when the press-fitting piece 221 is press-fitted into the press-fitting hole 204, the press-fitting piece 221 may be press-fitted obliquely relative to the arrow Y direction. In this case, there is a problem that an alignment error of a pair of male terminals 223 may occur, or the press-fitting piece 221 may shave an inner face of the press-fitting hole 204 to reduce holding power of the press-fitting piece 221. Further, according to the assembling structure of bus bar 201, while the bus bar 202 is assembled with the housing 203, an abutment position between the base portion 220 and the fixing portion 230 is only one point denoted by H in FIG. 7. Therefore, when outer force is applied to this bus bar 202, the bus bar 202 may be inclined in an arrow J direction in FIG. 7.

Accordingly, an object of the present invention is to provide an assembling structure of bus bar able to prevent a bus bar from being press-fitted obliquely when the bus bar is press-fitted into a housing, and able to prevent the bus bar from being displaced while the bus bar is assembled.

Solution to Problem

For achieving the object, according to a first aspect of the present invention, there is provided an assembling structure of bus bar including:

a bus bar; and a housing, wherein the bus bar is provided with a base portion extended in a band shape, a rectangular-plate-shaped press-fitting piece extended in a direction perpendicular to a longitudinal direction of the base portion from one end of the base portion, and an extended portion extended from the one end of the base portion and perpendicular to the press-fitting piece, wherein the housing is provided with a press-fitting hole into which the press-fitting piece is to be press-fitted, and wherein while the press-fitting piece is press-fitted into the press-fitting hole, the base portion and the extended portion abut on an outer periphery of the press-fitting hole.

Advantageous Effects of Invention

According to the first aspect of the present invention, the bus bar is provided with the base portion extended in a band shape, the rectangular-plate-shaped press-fitting piece extended perpendicular to the longitudinal direction of the base portion from the one end of the base portion, and the extended portion extended from the one end of the base portion and perpendicular to the press-fitting portion. Therefore, 2 5 when the press-fitting piece is press-fitted into the pres-fitting hole, the bus bar is pressed by two positions of the press-fitting piece, thereby the bus bar is prevented from being press-fitted obliquely. While the press-fitting piece is press-fitted into the press-fitting hole, two positions of the base portion and the extended portion abut on an outer periphery of the press-fitting hole. Therefore, the alignment accuracy of the bus bar is improved, and the bus bar is prevented from being displaced when the outer force is applied to the bus bar.

These and other objects, features, and advantages of the present invention will become more apparent upon reading of the following detailed description along with the accompanied drawings.

DESCRIPTION OF EMBODIMENTS

Figure 1:
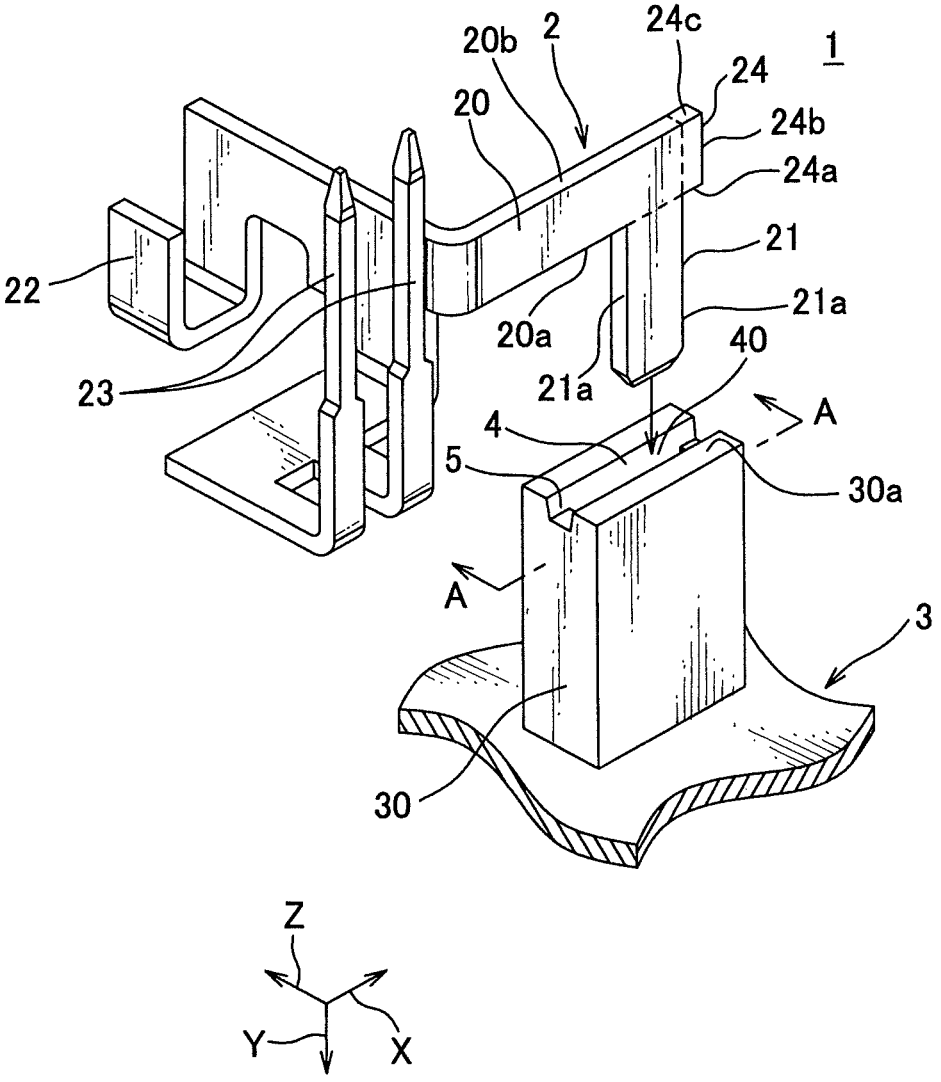
FIG. 1 is an exploded perspective view showing an assembling structure of bus bar according to an embodiment of the present invention.

An assembling structure of bus bar according to an embodiment of the present invention will be explained with reference to FIGS. 1 to 4. As shown in FIG. 1, an assembling structure of bus bar 1 is composed of a bus bar 2 made by pressing a metal plate and the like, and a synthetic-resin-made housing 3 with which the bus bar 2 is assembled.

The bus bar 2 is provided with a base portion 20 extended in a band shape, a rectangular-plate-shaped press-fitting piece 21 extended in a direction perpendicular to a longitudinal direction of the base portion 20 from one end of the base portion 20, an extended portion 24 extended from the one end of the base portion 20 and perpendicular to the press-fitting piece 21, a power-connecting portion 22 continued to the other end of the base portion 20 and into which electric power is inputted, and a pair of male terminals 23 continued to the center of the base portion 20 and electrically connected to a not-shown electronic component. Both end faces 21*a* in a width direction of the press-fitting piece 21 are extended straight, and not provided with a projection or the like. Further, a dotted line of the bus bar 2 in FIGS. 1 and 2 is a vertical line indicating a border between the base portion 20 and the press-fitting piece 21, and a border between the base portion 20 and the extended portion 24.

The housing 3 is provided with a fixing portion 30 to which the press-fitting piece 21 is fixed. An outer shape of this fixing portion 30 is formed in a box shape. The fixing portion 30 is provided with a press-fitting hole 4 into which the press-fitting piece 21 is to be press-fitted, and a groove 5 into which a part of the base portion 20 in the vicinity of the press-fitting piece 21 is to be inserted.

Further, in FIGS. 1 to 4, an arrow Y indicates a direction parallel to a longitudinal direction of the press-fitting piece 21 and a height direction of the fixing portion 30, an arrow X indicates a direction parallel to a width direction of the press-fitting piece 21 and a width direction of the fixing portion 30, and arrow Z indicates a direction parallel to a thickness direction of the press-fitting piece 21 and a thickness direction of the fixing portion 30.

Figure 2:
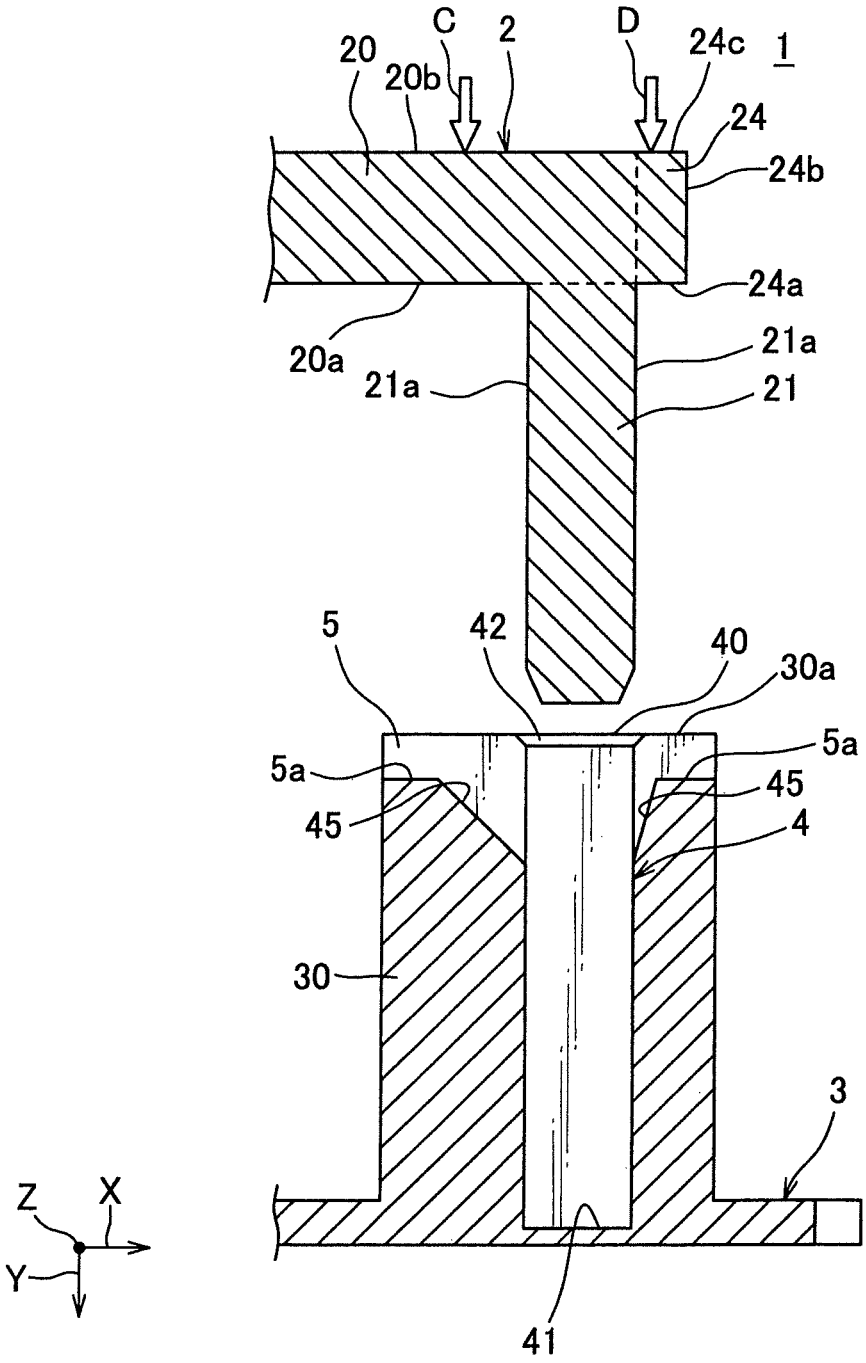
FIG. 2 is a sectional view taken on line A-A of FIG. 1.

As shown in FIG. 2, the press-fitting hole 4 is formed in a concave shape in the arrow Y direction from an upper face 30*a* of the fixing portion 30. The press-fitting hole 4 is composed of an opening 40, a bottom face 41, two planar faces opposed to each other in the arrow X direction, two planar faces opposed to each other in the arrow Z direction, and four tapered faces 42, 42, 45, 45 provided in the vicinity of the opening 40.

A size in a width direction (a size in an arrow X direction) of the press-fitting hole 4 is formed a little larger than a size in a width direction of the press-fitting piece 21, and a size in a thickness direction (a size in an arrow Z direction) of the press-fitting hole 4 is formed smaller than a size in a thickness direction of the press-fitting piece 21.

The groove 5 is formed in a concave shape in the arrow Y direction from the upper face 30*a* of the fixing portion 30, and extended in the arrow X direction. Reference sign 5*a* in FIGS. 2 and 4 indicates a bottom face of the groove 5.

Figure 3:
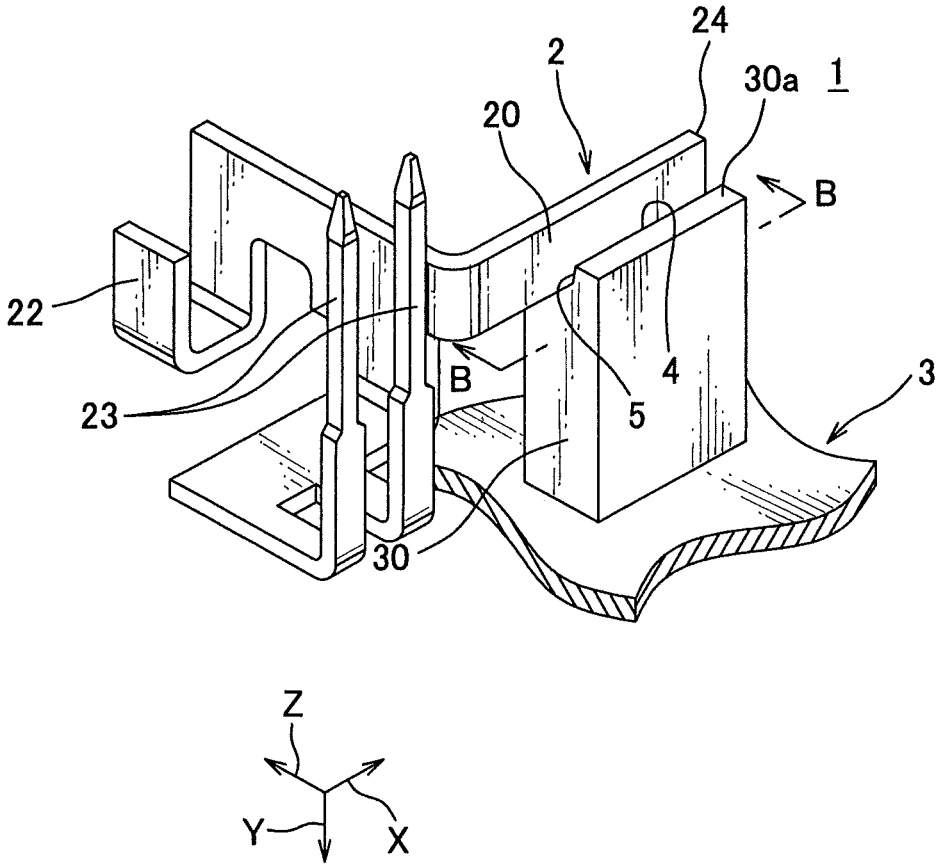
FIG. 3 is a perspective view showing a condition that a press-fitting piece shown in FIG. 1 is press-fitted into a press-fitting hole.
Figure 4:
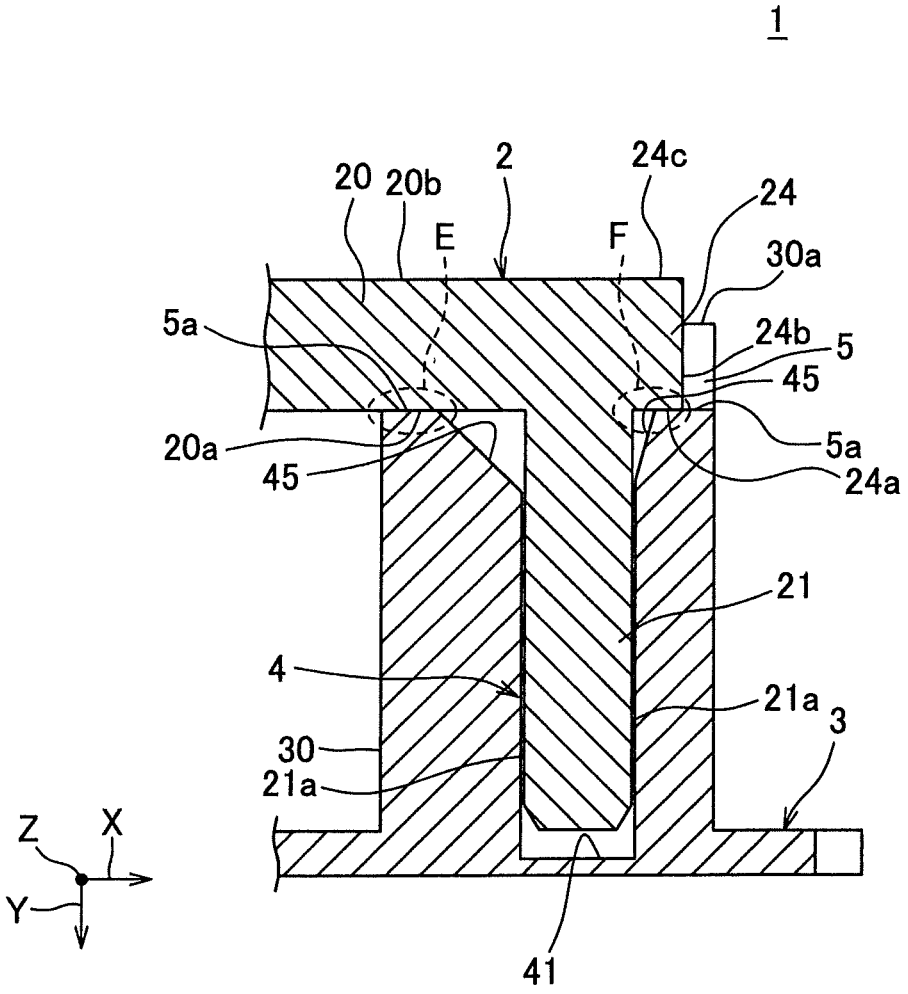
FIG. 4 is a sectional view taken on line B-B of FIG. 3.
Figure 5:
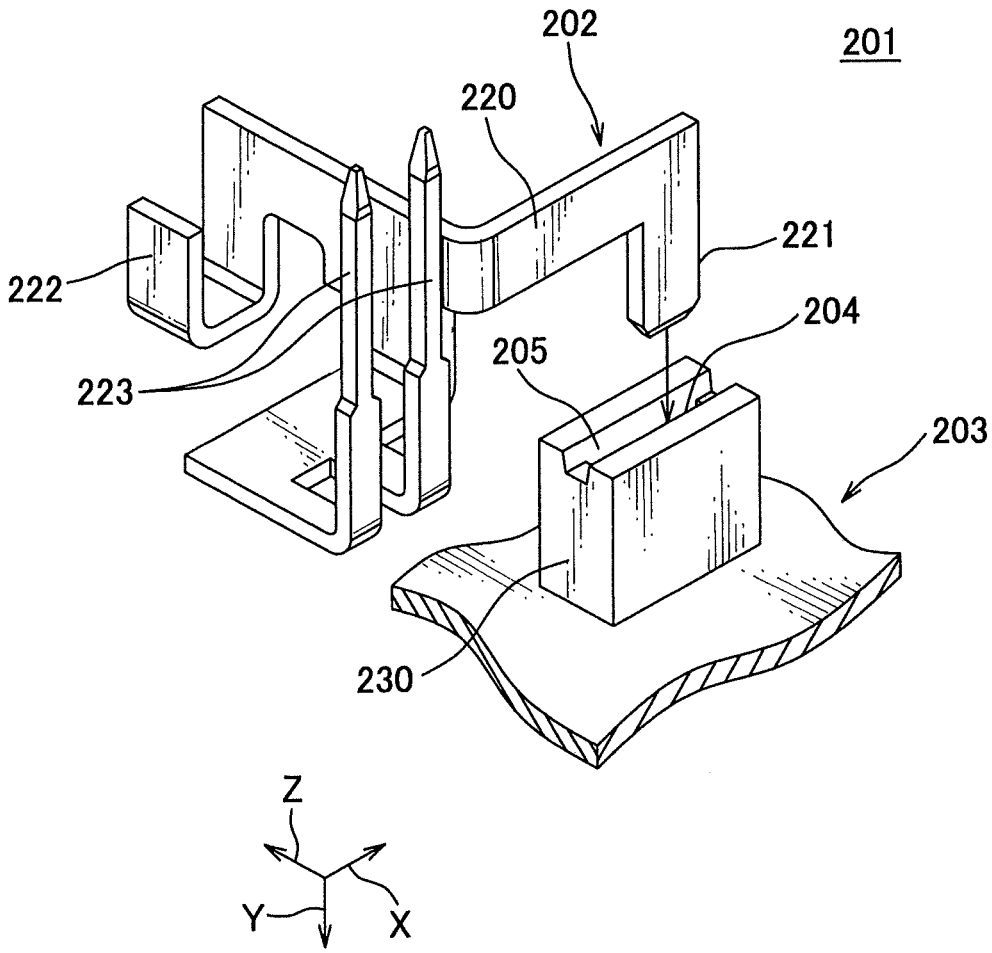
FIG. 5 PRIOR ART
FIG. 5 is an exploded perspective view showing a conventional assembling structure of bus bar.
Figure 6:
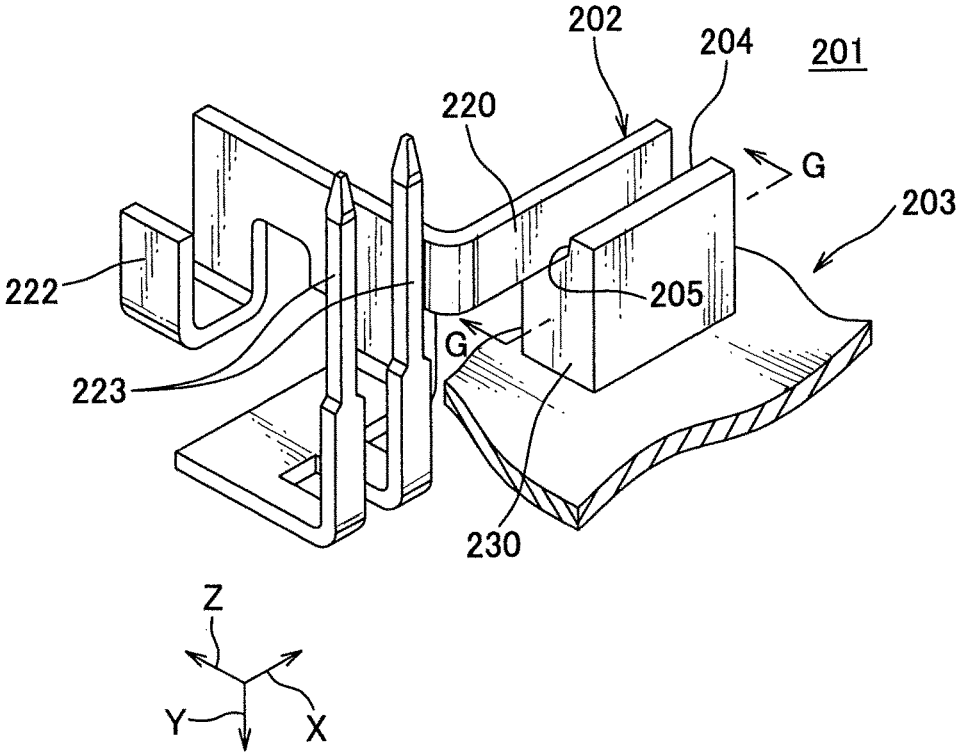
FIG. 6 PRIOR ART
FIG. 6 is a perspective view showing a condition that a press-fitting piece shown in FIG. 5 is press-fitted into a press-fitting hole.
Figure 7:
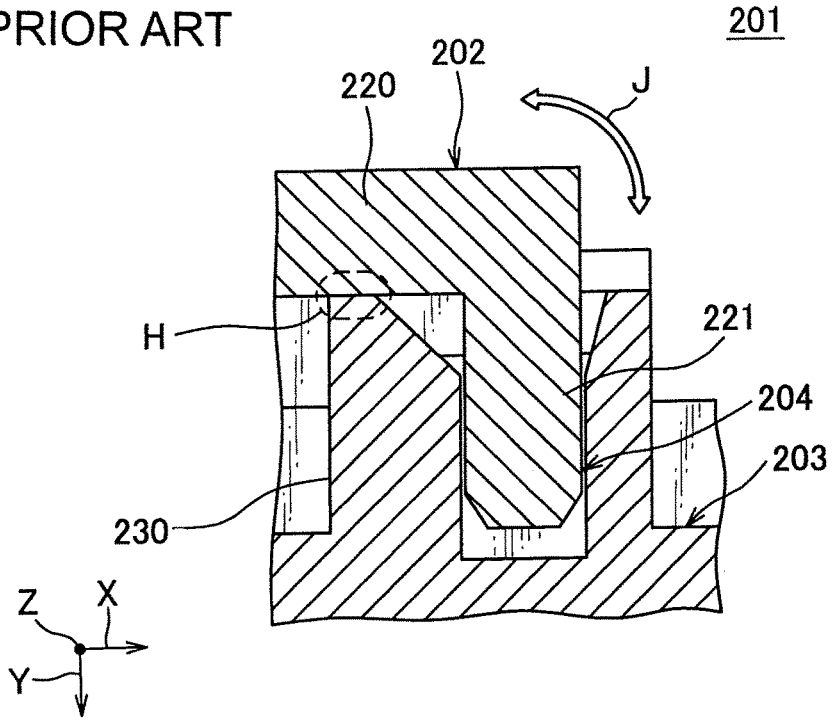
FIG. 7 PRIOR ART
FIG. 7 is a sectional view taken on line G-G of FIG. 6.

According to the assembling structure of bus bar 1 having the above configuration, as shown in FIGS. 3 and 4, when the press-fitting piece 21 is press-fitted into between two faces facing each other in the arrow Z direction of the press-fitting hole 4, the press-fitting piece 21 is fixed to the fixing portion 30. Then, when the press-fitting piece 21 is fixed to the fixing portion 30, the bus bar 2 is assembled with the housing 3. Further, when the press-fitting piece 21 is press-fitted into the pres-fitting hole 4, as shown by arrows C and D in FIG. 2, the bus bar 2 is pressed by two positions of the press-fitting piece 21, thereby the bus bar 2 is prevented from being press-fitted obliquely. Thus, according to the assembling structure of bus bar 1 of the present invention, because the press-fitting piece 21 can be press-fitted straight (arrow Y direction) into the press-fitting hole 4, the inner face of the press-fitting hole 4 is prevented from being shaved, and thereby, the holding power of the bus bar 2 is prevented from being reduced.

Further, according to the assembling structure of bus bar 1, while the press-fitting piece 21 is press-fitted into the press-fitting hole 4, two positions of the end face 20*a* of the base portion 20 and the end face 24*a* of the extended portion 24 abut on the bottom face 5*a* of the groove 5, namely, the outer periphery of the press-fitting hole 4. Reference sign E in FIG. 4 indicates the abutting position between the base portion 20 and the fixing portion 30, and reference sign F in FIG. 4 indicates the abutting position between the extended portion 24 and the fixing portion 30. Thus, according to the assembling structure of bus bar 1 of the present invention, while the press-fitting piece 21 is press-fitted into the press-fitting hole 4, two positions of the base portion 20 and the extended portion 24 abut on the outer periphery of the press-fitting hole 4. Therefore, the alignment accuracy (in particular, the alignment accuracy of the tips of the pair of male terminals 23) of the bus bar 2 is improved, and the bus bar 2 is prevented from being displaced when the outer force is applied to the bus bar 2.

Further, according to the assembling structure of bus bar 1, while the press-fitting piece 21 is press-fitted into the press-fitting hole 4, the end face 20*b* opposite to the end face 20*a* of the base portion 20, and the end faces 24*b*, 24*c* of the extended portion 24 do not abut on any part of the housing 3. Thus, according to the assembling structure of bus bar 1 of the present invention, because a part abutting on the end face 24*b* of the extended portion 24 is not provided on the housing 3, the press-fitting piece 21 can be easily press-fitted into the press-fitting hole 4.

Although the present invention has been fully described by way of example with reference to the accompanying drawings, it is to be understood that various changes and modifications will be apparent to those skilled in the art.

Therefore, unless otherwise such changes and modifications depart from the scope of the present invention hereinafter defined, they should be construed as being included therein.

REFERENCE SIGNS LIST

1 assembling structure of bus bar
2 bus bar
3 housing
4 press-fitting hole
20 base portion
21 press-fitting piece
24 extended portion

What is claimed is:

1. An assembling structure of bus bar comprising:
a bus bar; and
a housing,
wherein the bus bar is provided with:
a base portion extending in a band shape,
a rectangular-plate-shaped press-fitting piece extending from the base portion and extending in a direction perpendicular to a longitudinal direction of the base portion, and
an extended portion being a part of the base portion extending beyond an intersection of the rectangular-plate-shaped press-fitting piece and the base portion, and the extended portion ending in the longitudinal direction at an end face,
wherein the housing is provided with a longitudinal direction of a press-fitting hole into which the press-fitting piece is to be press-fitted in a longitudinal direction of the base portion and provided with a groove into which a part of the base portion in a vicinity of the press-fitting piece is inserted,
wherein the press-fitting hole comprises: an opening; a bottom face; and four tapered faces provided adjacent to the opening, and is formed smaller than a thickness of the press-fitting piece in a thickness direction of the press-fitting piece, and
wherein while the press-fitting piece is press-fitted into the press-fitting hole, the base portion and the extended portion individually abut on a bottom of the groove at two locations in the longitudinal direction of the press-fitting hole, and a side of the extended portion located in a direction perpendicular to the longitudinal direction avoids abutting on the housing.

2. The assembling structure of bus bar according claim 1, wherein an end face in a width direction of the base portion and an end face in a width direction of the extended portion abut on a bottom face of a groove formed on the outer periphery of the press-fitting hole.

3. The assembling structure of bus bar according claim 2, wherein the base portion and the extended portion abut on the outer periphery of the press-fitting hole only at the bottom face of the groove.

* * * * *